US008360173B1

(12) United States Patent
Rives

(10) Patent No.: US 8,360,173 B1
(45) Date of Patent: Jan. 29, 2013

(54) POSITIVE ENGAGEMENT UNDERREAMER AND METHOD

(76) Inventor: Allen Kent Rives, Cypress, TX (US)

( * ) Notice: Subject to any disclaimer, the term of this patent is extended or adjusted under 35 U.S.C. 154(b) by 268 days.

(21) Appl. No.: 12/780,880

(22) Filed: May 15, 2010

Related U.S. Application Data

(60) Provisional application No. 61/178,607, filed on May 15, 2009.

(51) Int. Cl.
*E21B 7/28* (2006.01)

(52) U.S. Cl. ..... 175/263; 175/269; 175/384; 175/273; 175/286; 175/289

(58) Field of Classification Search ..... 175/384, 175/263, 267, 289, 286, 273, 269
See application file for complete search history.

(56) References Cited

U.S. PATENT DOCUMENTS 2,060,352 A * 11/1936 Stokes ..... 175/268
6,668,949 B1 * 12/2003 Rives ..... 175/269

* cited by examiner

*Primary Examiner* — William P Neuder
*Assistant Examiner* — Ronald Runyan
(74) *Attorney, Agent, or Firm* — David B. Dickinson

(57) ABSTRACT

An underreamer that can be assembled easily is formed from a tubular body having a flow tube running to a distal end delivering fluid which moves an actuator against the underreamer arms which are hinged to a moveable stop block and stopped to positively seat the arm at the end of a key slot to rigidly hold the underreamer arm in full extension during operations. Once hydraulic pressure is released, a spring moves the arm down the slot to a position where the arm can be removed from the slot in the underreamer body. A lower sub assembly is affixed to the underreamer body to prevent premature back off of the lower sub. Jets are disposed on either side of the underreamer to remove cuttings from the well bore. The tool is adaptable in the field for several hole sizes by adjustment in the length of the stop block and the angle of the flat on the top side of the key.

9 Claims, 2 Drawing Sheets

POSITIVE ENGAGEMENT UNDERREAMER AND METHOD

BACKGROUND OF INVENTION

The present invention generally relates to a retractable assembly to be included behind a bottom hole assembly of a drillstring. More particularly, the present invention relates to a retractable underreamer having retractable arms configured to retract or engage a borehole to provide cutting while remaining positively fixed against the well bore minimizing lateral movement of the cutters during reaming.

Underreamers, in oilfield parlance, refer to downhole assemblies configured to enlarge existing boreholes. Particularly, it is often preferable to drill a reduced diameter or "pilot" hole. Underreamers function to enlarge smaller pilot holes into finished larger-diameter boreholes. Often boreholes located below the lowest string of casing require bored diameters greater than the inner diameter of the preceding string of casing. For these circumstances, a collapsible underreamer is installed behind a smaller drill bit and is run through the casing to the lower bore location. Once below the casing, the collapsible underreamer is expanded and the larger borehole is drilled. Once the larger bore is complete, the underreamer is retracted and the entire drilling assembly, bit, measurement equipment, and underreamer, is retrieved through the newly drilled borehole and casing thereabove. Prior underreamers were limited in the amount of underreaming that could be performed because of physical limitations on the size of the arms deployed. In the present invention, a 5¾ inch underreamer can be used to underream up to an 8½ inch bore, while previous underreamers would be limited to a 7½ inch bore. The new design of the arm and the lateral support offered by the key and stop block combination permits large holes with little damaging vibration from the movement of the cutters across the well bore face.

SUMMARY OF INVENTION

The preferred embodiment of the present invention provides an underreamer having a body providing a longitudinal bore attachable in a drill string assembly; a hydraulic communication path through said longitudinal bore of said body; an arm, having a distal end providing a cutter surface, inserted in a slot on said body guided by a key from a closed position to an open position and which seats the extended arm in the open position, restraining said arm from further movement, said arm pivotally attached to a stop block slideably engaging a slot formed in said body actuated by a piston hydraulically moving said piston against said arm, and a resilient member or spring resisting movement of the stop block from seating against said body, and assisting in disengagement of the cutter arm from the well bore upon completion of the underreaming. The cutter surface can be formed with PDC buttons or other hardfacing, all in a manner well known in this art. The key which guides the arm into and out of engagement with the well bore wall is preferably rectangulated ovoid shaped to provide maximum support for the arm in its fully extended position. This embodiment can further provide a shear screw to restrain the piston from movement prior to engagement of the tool with the well bore intended to be underreamed. Upon deployment, the underreamer permits the piston/actuator end to match the radius of the arm surface to thereby provide full contact upon engagement of the arm with the well bore providing positive engagement of the arm by both the piston/actuator and the stop block slot rigidly holding the arm when underreaming.

The design of this underreamer permits the radius of the underreamer to be modified by changing the length of the stop block; a service, which can be provided in the field at the well site. The underreamer further provides directed jetting nozzles located on each longitudinal end of the underreamer body to remove cuttings.

In more detail, the underreamer comprises an upper sub adaptable to connect to a drill string tubular connected to an underreamer body and a lower sub connected on an opposing end of the underreamer body adaptable for connection to a drill string tubular, each providing an axial longitudinal bore therethrough; a flow tube having an upper bushing and a spring mounted thereon, inserted into the underreamer body and the secured therein by the upper sub, to thereby permit fluid communication to a lower end of the underreamer which provides a lower bushing permitting fluid to flow into a space to move an actuator; a plurality of longitudinal openings in said underreamer body providing slots on opposing lateral sides of said openings and a eccentric key slot formed in a lateral wall of each slot to accept a key; a stop block carried in said opposing lateral side slots providing a pivot pin opening; an arm in each longitudinal opening having a pin opening at an end connected to the stop block and providing cutter elements at an opposing end for engaging a well bore wall and underreaming the well bore upon engagement, said arm providing a slot for engaging of a key inserted in the lateral wall of the longitudinal opening; and, the lower sub connected to the top sub retaining the actuator which responds to pressure to move the arm and pinned stop block to seat against the body and at the end of the key slot in the arm.

The upper sub and the lower sub can provide one or more directed jetting nozzles to clear debris from an annulus of a well bore, which jetting nozzles are retained in the upper and lower subs by snap rings and which can therefore be changed out as needed in the field. The underreamer provides a shear screw to prevent premature engagement of the underreamer arms by restraining the actuator/piston from movement as slight changes in hydraulic pressure are experienced in the well bore. The underreamer and the lower sub are securely connected and provide a setscrew to prevent backing off of the bottom sub from the underreamer in operation. The lower sub can be connected to drill collars, a pilot hole drill bit or a bullnose plug as required by the needs of the driller.

A unique feature of this underreamer is the shape of the key and the cooperation between the key inserted in the underreamer body and underreamer arms to support them at their full extension. A key to support an underreamer arm is formed from an eccentric base adaptable to insert in an adjacent complementary slot in an underreamer body; and, an rectangulated ovoid shaped head connected to said base providing a flat terminal end to seat in a slot formed in a lateral side of the underreamer arm to provide slideable engagement of said key in said slot, and said key having a flattened top side parallel to the slot on said arm when the arm is at full extension from the underreamer body to provide contact with said arm along substantially all of the lateral side surface, thus minimizing vibration of the underreamer arm when in operation against a well bore wall.

DETAILED DESCRIPTION OF THE DRAWINGS

DETAILED DESCRIPTION OF AN EMBODIMENT OF THE INVENTION

Figure 1:
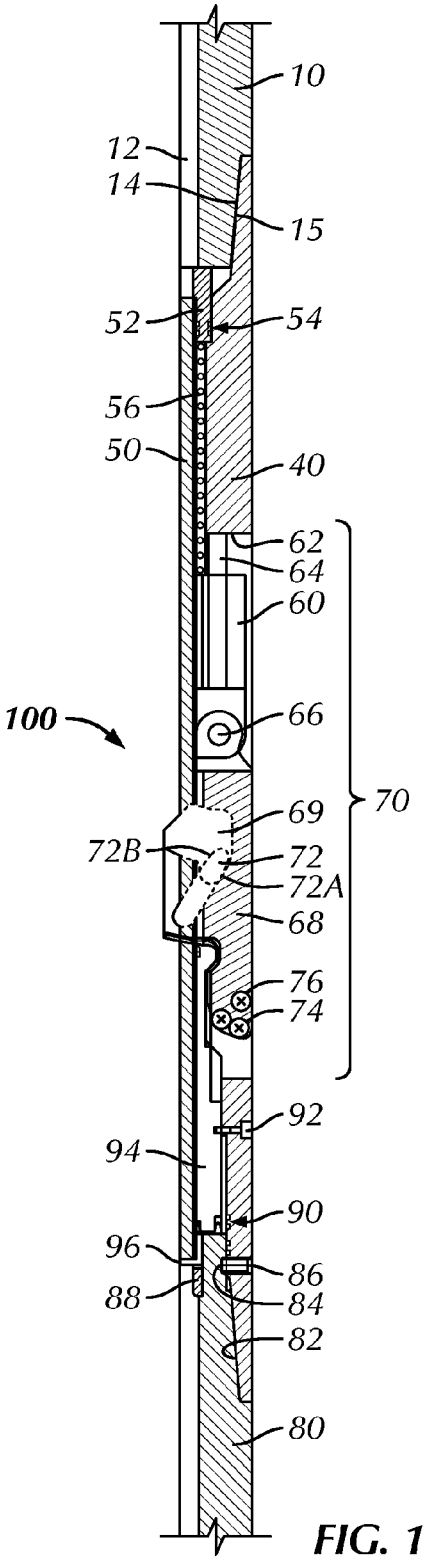
FIG. 1 is a detailed cross-sectional drawing of a portion of the underreamer of the present embodiment in the closed position.

FIG. 1 shows an underreamer 100 assembled by attaching an upper sub 10 having a longitudinal bore 12 therethrough to an underreamer body 40. Threads 14 in the upper sub 10 connect with threads 15 in the underreamer body 40 to attach the two bodies. Enclosed in the underreamer body 40 is a flow tube 50 that is seated in an upper bushing that provides seals 54 to prevent egress of fluid entering the flow tube 50. Spring 56 is placed around the flow tube 50 and seats against the upper bushing 52 and a shoulder on a stop block 60 urging the stop block 60 from remaining adjacent the terminus 62 formed in the underreamer body 40. Stop block 60 is provided with lateral tabs which engage slot 64 formed in opposing sides of slots 70 formed in the longitudinal axis of the underreamer body 40. The stop block 60 also provides a hole for a pin 66, which connects the stop block 60 to an arm 68 having a key slot 69 in which an rectangulated ovoid shaped key 72 seats.

Rectangulated ovoid shaped key 72 inserted in the arm slot 69 have a flattened surface that runs in parallel to the arm key slot 69. The key shape changes as the opening size desired by the driller changes. The shape of the key 72 has a bottom flat 72B parallel to the arm slot when the arm in the closed position and a top flat side 72A parallel to the arm slot 69 when the arm is in the opened position. The bottom side of the key 72B is nearest the inner diameter of the underreamer 100 and the topside of the key 72A is located closest to the outer diameter of the underreamer 100. For example, at a desired 8½ inch hole opening, the arm opens 7½ degrees from the longitudinal axis of the tool. Accordingly, the angle of the flat of the rectangulated ovoid key relative to the slot is 7½ degrees so that when fully opened, the key and arm slot are parallel to each other yielding the maximum contact area of key slot and key. At a desired opening of 7½ inches, the arm only opens 5 degrees when fully opened. The key for the 7½ inch underreamer provides an angle of 5 degrees relative to the arm slot thereby providing the key and the arm slot to be parallel at full opening as dictated by the stop block. This relationship can be readily adapted to any size opening desired by modifying the stop block length, the arm key slot and the key shape to accommodate such changes.

At a distal end of arm 68 cutter elements 74, 76, such as polycrystalline diamond cutter (PDC) elements, are inserted to engage the borehole to be underreamed. In the present configuration, a set of primary PDC buttons 74 are inserted, and provide secondary PDC buttons 76. Another secondary PDC (not visible in this view) is mounted on the trailing edge of the arm 68 to assist in opening the well bore WB.

FIG. 1 also discloses the position of the actuator 94 that, in this embodiment, is pinned to the underreamer body 40 by shear screw 92 to prevent premature movement of the actuator 94 against the arm 68. Drilling fluid moves down the flow tube 50 through the opening 96 in lower bushing 88, which is retained between the bottom sub 80 and the flow tube 50. The underreamer body 40 provides a setscrew 86 that is inserted in the lower sub 80 in recess 84 to prevent the lower sub 80 from backing off the underreamer body 40 during operations. The underreamer body 40 also provides seals 90 to prevent fluid egress from the space filled through flow passage or opening 96 that moves the actuator 94 to engage the underreamer arm 68. Lower sub 80 is connected to the underreamer body 40 with threads 82, all in a manner well known to those skilled in this art.

Figure 2:
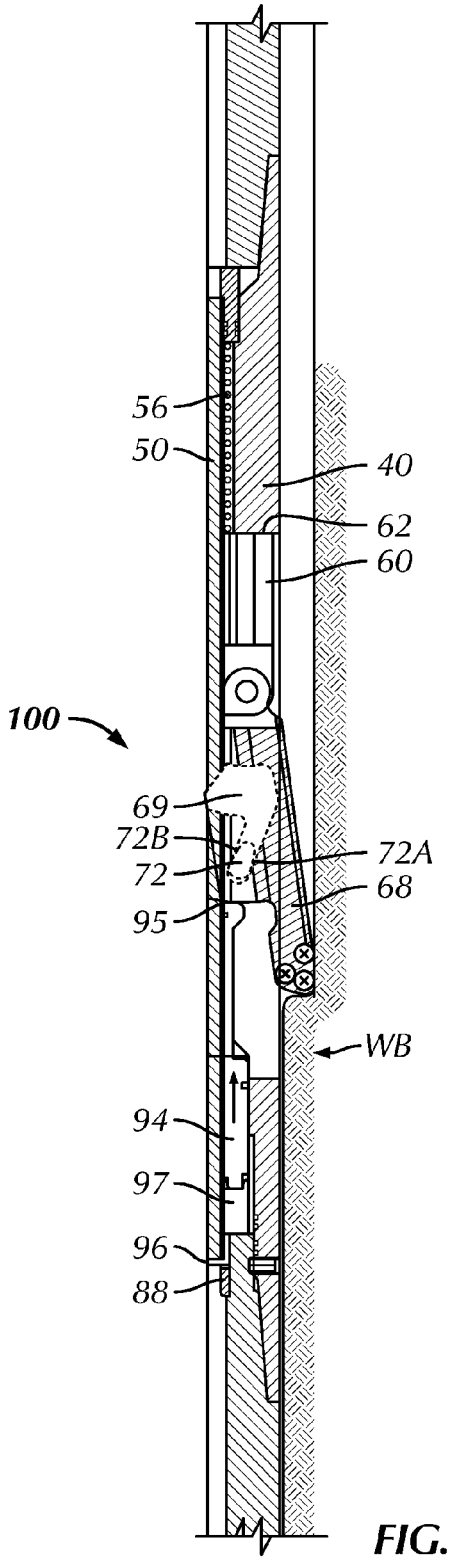
FIG. 2 is a detailed cross-sectional drawing of a portion of the underreamer of the present embodiment in the open position.

FIG. 2 shows the same tool after having increased pump pressure to fill the space 97 and thereby move the actuator 94 up against the edge of arm 68 and out into engagement with the wellbore WB. As long as the pump pressure is kept at the point to overcome resistance from the spring 56, the arm 68 will remain deployed against the well bore WB to underream the formation. The head 95 of actuator 94 engages the full radius of the arm 68 restraining the key 72 in the bottom of the key slot 69, providing positive pressure to arm 68 to prevent unnecessary vibration and movement as the arm 68 sweeps across the wellbore face WB. Simultaneously, the stop block 60 is seated against the body 40 at its stop position 62, providing further positive engagement of the underreamer 100.

Figure 3:
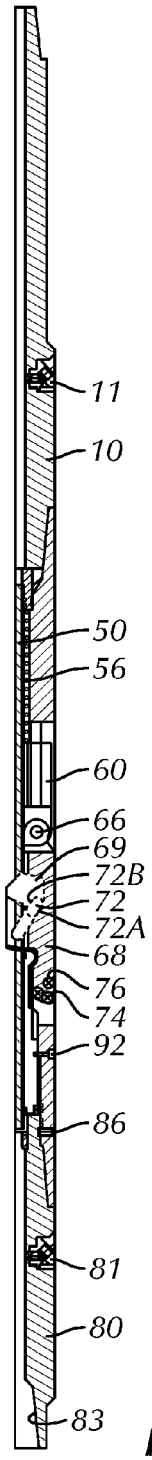
FIG. 3 is a detailed cross-sectional drawing of the entire underreamer assembly of the present invention.

FIG. 3 is a view similar to FIG. 1 showing the underreamer embodiment of the present invention prior to engagement of the well bore showing the complete assembly. Each number on FIG. 1 can be read in FIG. 3. The upper sub 10 shows the placement of the snap-ring jetting nozzles 11 which need no cutting or welding to remove and replace and which can therefore be field-serviced as needed. Upper sub 10 provides threads 14 for connection to a drill-string assembly. A similar set of nozzles 81 (only one of which is shown) can be found in the lower sub 80 that similarly provides female threads for connection in a drill string. The threads 83 can connect to a drill bit, a bull-nose plug or other drilling devices in a manner well known in the art and depending on the needs of the driller. The easy replacement of jetting nozzles in the field allows the driller to adjust fluid flow around the underreamer assembly as conditions dictate. If more fluid needs to flow around the top end of the assembly, larger jets 11 can be installed in the top jetting ports to permit such flow. These top jets 11 also permit the driller to adjust the amount of fluid flowing through the flow tube 50 thereby preventing a wash out of the tube if flow becomes too high. Bottom jets 81 can be readily changed out to accommodate fluid flow considerations as well.

Figure 4:
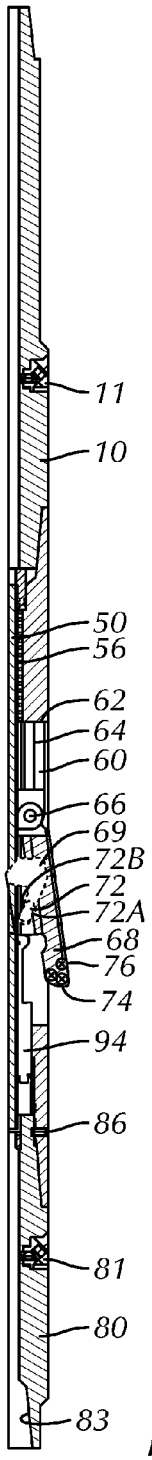
FIG. 4 is a second embodiment of the underreamer with the shorter stop block limiting the opening of the underreamer arm.

FIG. 4 is a similar tool to FIG. 2 but is fitted with a shorter stop block 60, which restricts the movement of the arm 68 in the groove 64, and therefore permits the driller to limit the diameter of the underreaming. The stop block 60 can be field changed to permit different diameters to be reamed with the same arm, since the slot 70 (as shown in FIG. 5) formed in the underreamer body is always of uniform length.

Figure 5:
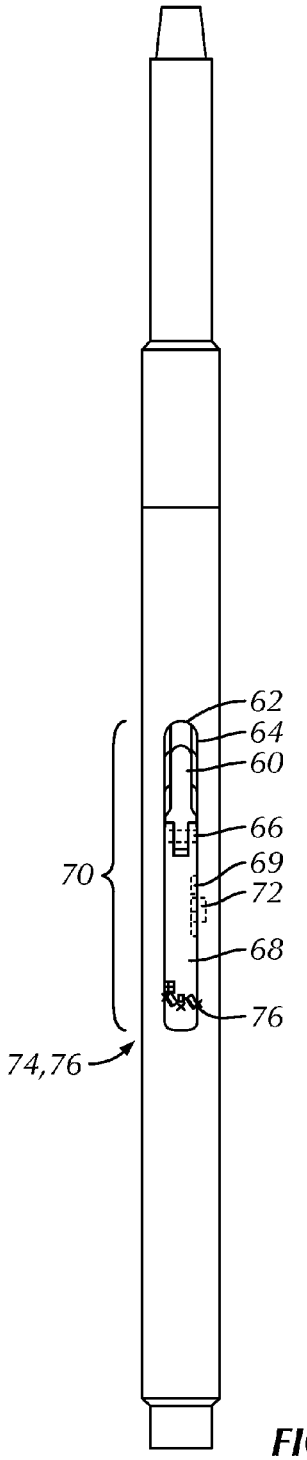
FIG. 5 is a topside view of the slot in which the underreamer arm retracts.

As can be readily seen from the profile of FIG. 5, the stop block 60 travels in groove 64 and is stopped at the body face 62. Adjusting the size of the stop block permits greater or lesser movement of the attached arm 68 and thereby controls the size of the hole opened by the underreamer. Since the stop block 60 and the key 72 in key slot 69 restrain the arm 68 in a fixed position, the vibration and jiggling of the arm are minimized, increasing the useful life of the tool.

Numerous embodiments and alternatives thereof have been disclosed. While the above disclosure includes the best mode belief in carrying out the invention as contemplated by the named inventor, not all possible alternatives have been disclosed. For that reason, the scope and limitation of the present invention is not to be restricted to the above disclosure, but is instead to be defined and construed by the appended claims.

The invention claimed is:

1. An underreamer comprising:

a body providing a longitudinal bore attachable in a drill string assembly;

a hydraulic communication path through said longitudinal bore of said underreamer body;

an arm, having a distal end providing a cutter surface, inserted in a slot on said underreamer body guided from a closed position to an open position by a rectangulated ovoid shaped key which seats the extended arm in the open position, restraining said arm from further movement, said arm pivotally attached to a stop block slideably engaging a stop block slot formed in said body; the rectangulated ovoid shaped key supporting the arm and providing an eccentric base adaptable to insert in an adjacent complementary key slot in the underreamer body;

a head connected to said eccentric base providing a flat terminal end to seat in the key slot formed in a lateral side of the underreamer arm to provide slideable engagement of said key in said key slot, said key having a flattened top side parallel to the key slot on said arm when the arm is at full extension from the underreamer body to provide contact with said arm along substantially all of the lateral side surface of the key slot; and, a resilient member resisting movement of the stop block from seating against said underreamer body.

2. The underreamer of claim 1 wherein the radius of the extended underreamer arm can be modified by changing the length of the stop block and dimensions of the key.

3. The underreamer of claim 1 further comprising directed jetting nozzles to remove cuttings located on said body on each longitudinal end of the underreamer.

4. An underreamer comprising:

an upper sub adaptable to connect to a drill string tubular connected to an underreamer body and a lower sub connected on an opposing end of the underreamer body adaptable for connection to a drill string tubular, each providing an axial longitudinal bore therethrough;

a flow tube having an upper bushing and a spring mounted thereon, inserted into the underreamer body and the secured therein by the upper sub, to thereby permit fluid communication to a lower end of the underreamer which provides a lower bushing permitting fluid to flow into a space to move an actuator;

a plurality of longitudinal openings in said underreamer body providing slots on opposing lateral sides of said openings and an eccentric key slot formed in a lateral wall of each slot to accept a key;

a stop block carried in said opposing lateral side slots providing a pivot pin opening;

an arm in each longitudinal opening having a pin opening at an end connected to the stop block and providing cutter elements at an opposing end for engaging a well bore wall and underreaming the well bore upon engagement, said arm providing a slot for engaging of a key, inserted in the lateral wall of the longitudinal opening; and, a lower sub connected to the underreamer body retaining the actuator that responds to pressure to move the arm and stop block to seat against the body and at a distal end of the key slot in the arm.

5. The underreamer of claim 4 wherein the upper sub and the lower sub provide a directed jetting nozzle to clear debris from an annulus of a well bore.

6. The underreamer of claim 4 wherein the underreamer provides a shear screw to prevent premature engagement of the underreamer arms.

7. The underreamer of claim 4 wherein the underreamer and the lower sub are securely connected and provide a set screw to prevent backing off of the bottom sub from the underreaming in operation.

8. A method for field-dressing an underreamer comprising:

selecting a stop-block providing tab on each side for insertion in a groove formed on each adjacent side of a slot of an underreamer body providing a moveable track having a length inversely proportional to the desired underreamed diameter;

selecting and fitting a key slot block into a seat formed in an adjacent surface of a slot in the underreamer body;

pinning the stop-block to an underreamer arm;

inserting the stop-block and arm into an underreamer body seating the stop-block in a longitudinal track in said body and lowering the key slot over the key;

moving an actuator to engage a radius of each arm; and, pinning the actuator in a fixed position by tightening a setscrew through a lower sub.

9. The method of claim 8 further comprising installing jetting nozzles in each nozzle seat on an upper sub and a lower sub and locking said nozzles in said upper and lower sub with a snap ring.

* * * * *